US006908519B2

(12) United States Patent
Raymond et al.

(10) Patent No.: US 6,908,519 B2
(45) Date of Patent: Jun. 21, 2005

(54) ISOTHERMAL FORGING OF NICKEL-BASE SUPERALLOYS IN AIR

(75) Inventors: Edward Lee Raymond, Maineville, OH (US); Shesh Krishna Srivatsa, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 269 days.

(21) Appl. No.: 10/199,186

(22) Filed: Jul. 19, 2002

(65) Prior Publication Data

US 2004/0221927 A1 Nov. 11, 2004

(51) Int. Cl.[7] ..... C22C 1/10
(52) U.S. Cl. ..... 148/677; 148/676
(58) Field of Search ..... 148/676, 677

(56) References Cited

U.S. PATENT DOCUMENTS

| | | | | |
|---|---|---|---|---|
| 3,660,177 A | * | 5/1972 | Brown et al. | 148/677 |
| 3,802,938 A | * | 4/1974 | Collins et al. | 419/28 |
| 4,740,354 A | | 4/1988 | Watanabe et al. | |
| 5,120,373 A | * | 6/1992 | Miller et al. | 148/564 |
| 5,556,484 A | | 9/1996 | Blankenship | |
| 5,649,280 A | | 7/1997 | Henry et al. | |
| 2004/0084118 A1 | * | 5/2004 | Raymond et al. | 148/676 |

FOREIGN PATENT DOCUMENTS

GB 1 253 861 A 11/1971

OTHER PUBLICATIONS

Metals Handbook ($10^{th}$ Edition) vol. 1, Properties and Selection: Irons, Steels, and High Performance Alloys, 1990, pp. 950, 951, 970 and 982.*

Huron E. et al, "Control of Grain Size Via Forging Strain Rate Limits for R'88DT", Superalloys Proceedings International Symposium Superalloys, vol. 9, pp. 49–58 (XP009019521).

Gabb, Timothy P. and O'Connor, Kenneth, "High Temperature, Slow Strain Rate Forging of Advanced Disk Alloy ME3", National Aeronautics and Space Administration, Aug. 2001, NASA/TM—2001–210901 (XP–01155723).

* cited by examiner

*Primary Examiner*—John P. Sheehan
(74) *Attorney, Agent, or Firm*—McNees Wallace & Nurick LLC

(57) ABSTRACT

A superalloy made of a forging nickel-base superalloy such as Rene™ 88DT or ME3 is forged in a forging press having forging dies made of a die nickel-base superalloy. The forging is accomplished by heating to a forging temperature of from about 1700° F. to about 1850° F., and forging at that forging temperature and at a nominal strain rate. The die nickel-base superalloy is selected to have a creep strength of not less than a flow stress of the forging nickel-base superalloy at the forging temperature and strain rate.

19 Claims, 2 Drawing Sheets

ISOTHERMAL FORGING OF NICKEL-BASE SUPERALLOYS IN AIR

This invention relates to the forging of nickel-base superalloys and, more particularly, to such forging performed in air.

BACKGROUND OF THE INVENTION

Nickel-base superalloys are used in the portions of aircraft gas turbine engines which have the most demanding performance requirements and are subjected to the most adverse environmental conditions. Cast nickel-base superalloys are employed, for example, as turbine blades and turbine vanes. Wrought nickel-base superalloys are employed, for example, as rotor disks and shafts. The present invention is concerned with the wrought nickel-base superalloys.

The wrought nickel-base superalloys are initially supplied as cast ingots, which are cast from the melt, or as consolidated-powder billets, which are consolidated from powders. The consolidated-powder billets are preferred as the starting material for many applications because they have a uniform, well-controlled initial microstructure and a fine grain size. In either case, the billet is reduced in size in a series of steps by metal working procedures such as forging or extrusion, and is thereafter machined. In one form of forging, the billet is placed between two forging dies in a forging press. The forging dies are forced together by the forging press to reduce the thickness of the billet.

The selection of the forging conditions depends upon several factors, including the properties and metallurgical characteristics of the nickel-base superalloy and the properties of the materials of the forging dies. The forging dies must be sufficiently strong to deform the material being forged, and the forged superalloy must exhibit the required properties at the completion of the forging operation.

At the present time, nickel-base superalloys, such as Rene™ 88DT and ME3 alloys, are isothermally forged at or above a temperature of about 1900° F. using TZM molybdenum dies. This combination of the superalloy being forged and the die material allows the forging to be performed, and the superalloy has the required properties at the completion of the forging. However, this combination of temperature, the superalloy being forged, and the die material requires that the forging be performed in vacuum or in an inert-gas atmosphere. The requirement of a vacuum or an inert-gas atmosphere greatly increases the complexity and cost of the forging process.

There is a need for an improved approach to the forging of nickel-base superalloys that achieves the required properties and also reduces the forging cost. The present invention fulfills this need, and further provides related advantages.

BRIEF SUMMARY OF THE INVENTION

The present invention provides a method for forging nickel-base superalloys such as Rene™ 88DT and ME3. The method allows the forging to be performed isothermally in air, resulting in a substantial cost saving. The final microstructure has the desired grain structure, and is consistent with and permits additional processing such as supersolvus final annealing.

The present invention provides a method for forging a superalloy comprising the steps of providing a forging blank of a forging nickel-base superalloy, and providing a forging press having forging dies made of a die nickel-base superalloy. The die nickel-base superalloy desirably has a creep strength of not less than the flow stress of the forging nickel-base superalloy at a forging temperature of from about 1700° F. to about 1850° F. and a forging nominal strain rate. The method further includes heating the forging blank and the forging dies to the forging temperature of from about 1700° F. to about 1850° F., and forging the forging blank using the forging dies at the forging temperature of from about 1750° F. to about 1850° F. and at the forging nominal strain rate.

The forging blank is made of the forging nickel-base superalloy, preferably Rene™ 88DT, having a nominal composition, in weight percent, of 13 percent cobalt, 16 percent chromium, 4 percent molybdenum, 3.7 percent titanium, 2.1 percent aluminum, 4 percent tungsten, 0.75 percent niobium, 0.015 percent boron, 0.03 percent zirconium, 0.03 percent carbon, up to about 0.5 percent iron, balance nickel and minor impurity elements; or alloy ME3, having a nominal composition, in weight percent, of about 20.6 percent cobalt, about 13.0 percent chromium, about 3.4 percent aluminum, about 3.70 percent titanium, about 2.4 percent tantalum, about 0.90 percent niobium, about 2.10 percent tungsten, about 3.80 percent molybdenum, about 0.05 percent carbon, about 0.025 percent boron, about 0.05 percent zirconium, up to about 0.5 percent iron, balance nickel and minor impurity elements. These forging nickel-base superalloys exhibit superplasticity over a respective superplastic temperature range at elevated temperature. The forging deformation is desirably accomplished in the superplastic temperature range to avoid critical grain growth in the subsequent supersolvus anneal The nickel-base superalloys may be furnished in any operable form, such as cast-wrought or consolidated-powder billets. Preferably, however, the nickel-base superalloys are furnished as extruded billet with a grain size of not less than ASTM 12 (i.e., grain sizes of ASTM 12 or smaller).

The forging dies may be made of any operable die nickel-base superalloy, but preferably have a nominal composition, in weight percent, of from about 5 to about 7 percent aluminum, from about 8 to about 15 percent molybdenum, from about 5 to about 15 percent tungsten, up to about 140 parts per million magnesium (preferably about 140 parts per million magnesium), no rare earths, balance nickel and impurities.

The selections of the isothermal forging temperature and forging nominal strain rate are based upon consideration of the physical properties of the forging nickel-base superalloy and of the die nickel-base superalloy, and also of the temperature requirement to achieve the required structure in the forging nickel-base superalloy at the completion of the processing. The die nickel-base superalloy has sufficient creep strength to deform the forging nickel-base superalloy. With increasing temperature, the compressive strength and the creep strength of both the forging nickel-base superalloy and the die nickel-base superalloy fall, but at different rates. Additionally, for the preferred forging nickel-base superalloy, the selected forging temperature must be within the superplastic range of the alloy to ensure the proper final microstructure. Further, to accomplish the preferred forging in air, the forging temperature must not be so high that the forging nickel-base superalloy and the die nickel-base superalloy excessively oxidize.

With these considerations in mind, the isothermal forging temperature range of from about 1700° F. to about 1850° F. was selected. More preferably, the isothermal forging temperature is from about 1750° F. to about 1800° F. The forging nominal strain rate was selected to be not greater than about 0.010 per second. Testing showed that higher strain rates within the forging temperature range result in critical grain growth in the final processed article.

The heating and isothermal forging steps are preferably performed in air, at the indicated temperatures. Forging in air, rather than in inert gas or vacuum as required when TZM molybdenum dies are used, saves on the costs of special heating and forging equipment.

After the forging processing according to the present approach, the forging may be used in the as-forged state, or post processed by any operable approach, such as cleaning, heat treating, additional metalworking, machining, and the like. In one further processing of interest, the forging is heat treated by annealing at an annealing temperature above the gamma prime solvus temperature, or typically about 2100° F. for Rene™ 88DT alloy and 2160° F. for ME3 alloy.

The present approach provides a technique for forging nickel-base superalloys that results in fully acceptable metallurgical structures and properties in the final forging, while significantly reducing the cost of the forging operation by permitting the isothermal forging to be accomplished in air. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
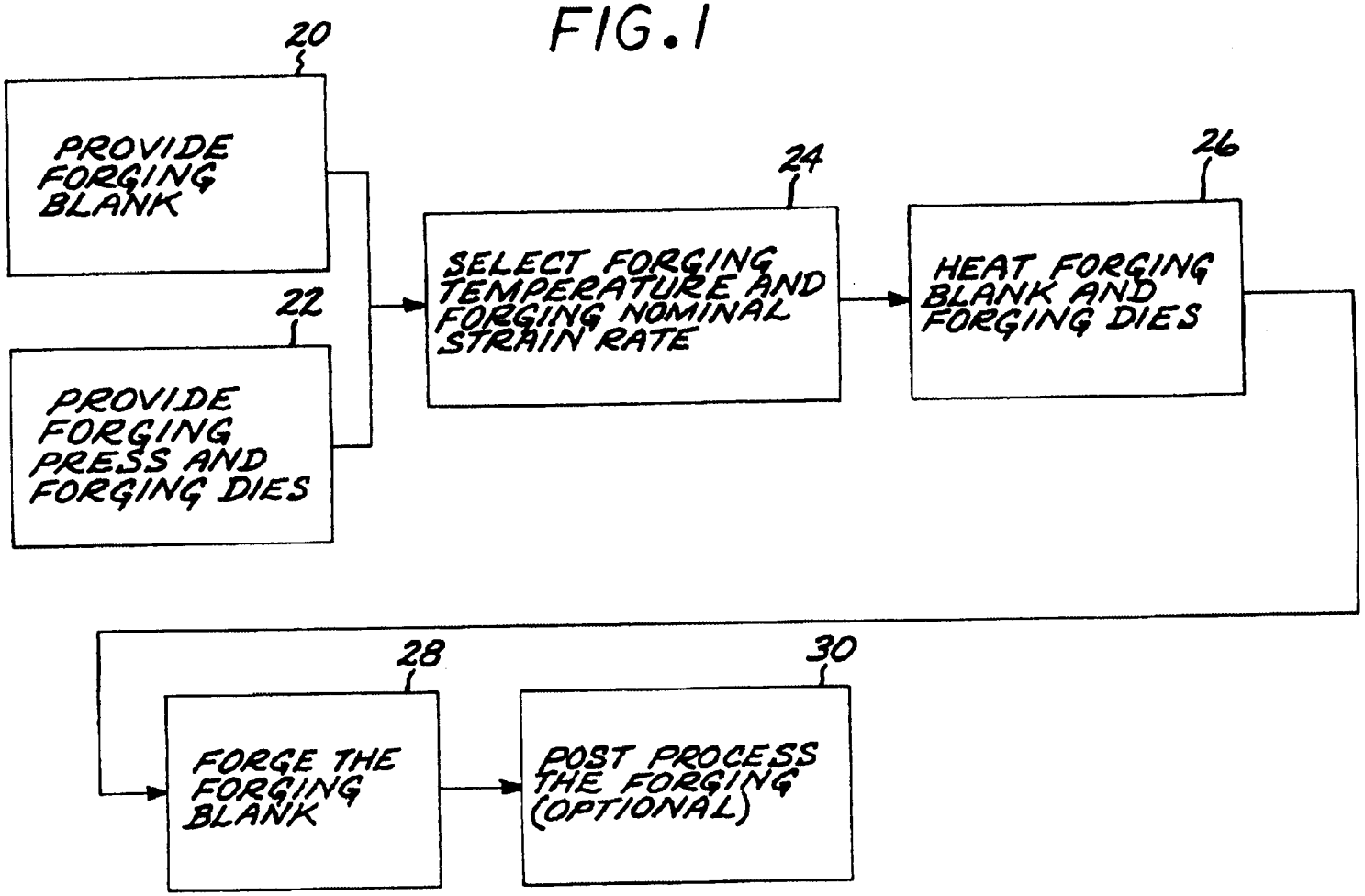
FIG. 1 is a block flow diagram of an approach for practicing the invention.

FIG. 1 depicts a preferred approach for practicing the invention. A forging blank is provided, step 20. The forging blank is made of a forging nickel-base superalloy. As used herein, an alloy is nickel-base when it has more nickel than any other element, and is further a nickel-base superalloy when it is strengthened by the precipitation of gamma prime or related phases. Two nickel-base superalloys of particular interest are Rene™ 88DT, having a nominal composition, in weight percent, of 13 percent cobalt, 16 percent chromium, 4 percent molybdenum, 3.7 percent titanium, 2.1 percent aluminum, 4 percent tungsten, 0.75 percent niobium, 0.015 percent boron, 0.03 percent zirconium, 0.03 percent carbon, up to about 0.5 percent iron, balance nickel and minor impurity elements; and alloy ME3, having a nominal composition, in weight percent, of about 20.6 percent cobalt, about 13.0 percent chromium, about 3.4 percent aluminum, about 3.70 percent titanium, about 2.4 percent tantalum, about 0.90 percent niobium, about 2.10 percent tungsten, about 3.80 percent molybdenum, about 0.05 percent carbon, about 0.025 percent boron, about 0.05 percent zirconium, up to about 0.5 percent iron, balance nickel and minor impurity elements.

The nickel-base superalloys are furnished in any operable form, but preferably are furnished as consolidated-powder billets. These billets are made by consolidating powders of the selected superalloy by extrusion, producing a billet having a uniform grain size of ASTM 12 or higher (that is, ASTM 12 or finer grains, inasmuch as the grain size decreases with increasing ASTM grain size number). Consolidated-powder billets have the advantage over cast billets in having a more-uniform fine-grain microstructure and are therefore preferred for achieving good chemical uniformity, good deformation homogeneity, and minimal sites for crack initiation.

The forging blank has a size and shape selected so that, after forging, the forged article is of the desired size and shape. Procedures are known in the art for selecting the size and shape of the starting forging blank so as to yield the required finished size and shape.

Figure 2:
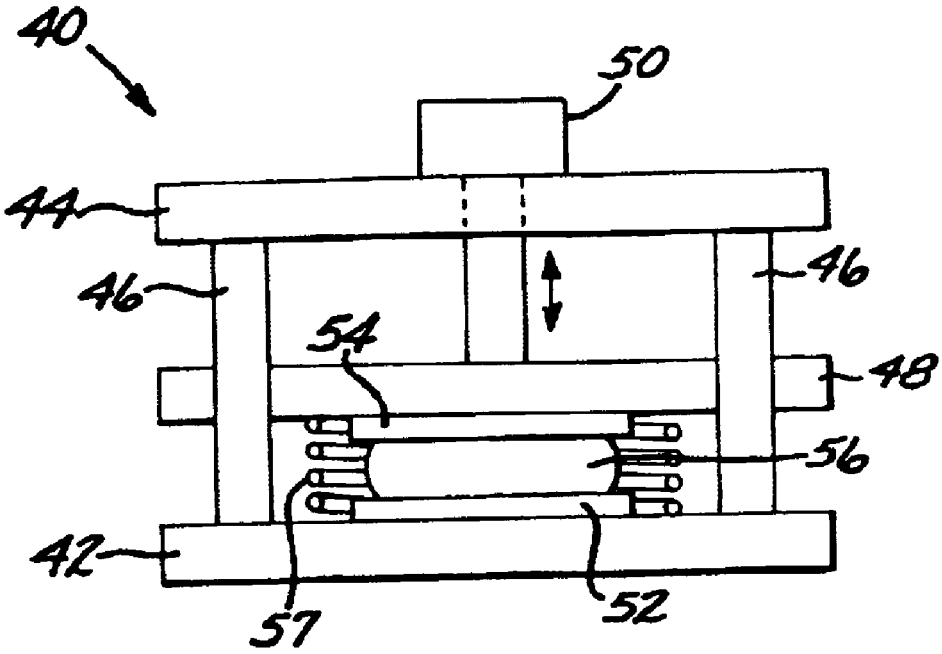
FIG. 2 is a schematic elevational view of a forging press and an article being forged.

A forging press and forging dies are provided, step 22. Any operable forging press may be used, and FIG. 2 schematically depicts a basic forging press 40. The forging press 40 has a stationary lower platen 42, a stationary upper plate 44, and stationary columns 46 that support the upper plate 44 from the lower platen 42. A movable upper platen 48 slides on the columns 46, and is driven upwardly and downwardly by a drive motor 50 on the upper plate 44. A lower forging die 52 is stationary and sits on the lower platen 42. An upper forging die 54 is movable and is affixed to the upper platen 48 so that it rides upwardly and downwardly with the upper platen 48. A workpiece 56 is positioned between the upper forging die 54 and the lower forging die 52. A heater 57, here illustrated as an induction heating coil, is positioned around the forging dies 52 and 54, and the workpiece 56, to maintain the forging dies and the workpiece at a selected approximately constant isothermal forging temperature during the forging stroke, thereby achieving isothermal forging. Some minor variation in temperature is permitted during the forging stroke, but in general the forging dies 52 and 54 and the workpiece 56 remain at approximately the constant isothermal forging temperature.

Figure 3:
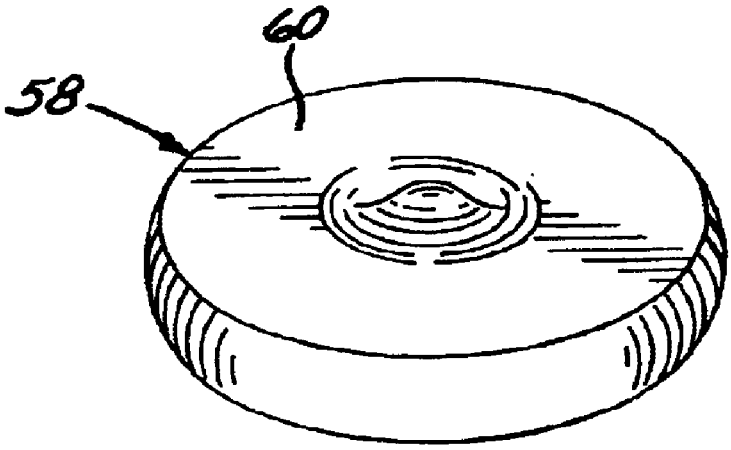
FIG. 3 is a schematic perspective view of a forging.

The workpiece 56 is initially the forging blank of the forging nickel-base superalloy. The workpiece 56 is positioned between the upper forging die 54 and the lower forging die 52 and is compressively deformed at a nominal strain rate by the movement of the upper forging die 54 in the downward direction. The upper forging die 54 and the lower forging die 52 may be flat plates, or they may be patterned so that the final forging has that pattern impressed thereon. FIG. 3 is an exemplary forging 58 with a patterned face 60 produced using patterned forging dies.

The forging dies 52 and 54 are made of a die nickel-base superalloy, wherein the die nickel-base superalloy has a creep strength of not less than the flow stress of the forging nickel-base superalloy at an isothermal forging temperature of from about 1700° F. to about 1850° F. and a forging nominal strain rate. The forging dies 52 and 54 are preferably made with a nominal composition, in weight percent, of from about 5 to about 7 percent aluminum, from about 8 to about 15 percent molybdenum, from about 5 to about 15 percent tungsten, up to about 140 parts per million magnesium (preferably 140 parts per million magnesium), balance nickel and impurities.

A forging temperature and forging nominal strain rate are selected, step 24. The forging nickel-base superalloys exhibit superplasticity over a respective superplastic temperature range and strain-rate range at elevated temperature. The forging deformation is desirably accomplished in the superplastic temperature range to avoid critical grain growth in the subsequent supersolvus anneal.

The acceptable range of temperatures and strain rates may be determined from the plastic deformation properties of the forging nickel-base superalloy. The following Tables I and II respectively present the results of laboratory tests on Rene™ 88DT and ME3 alloys to determine the operable isothermal forging temperatures and strain rates:

TABLE I (Rene ™ 88DT alloy)

| Temperature ° F. | Strain Rate (/sec) | Stress (ksi) | "m" |
|---|---|---|---|
| 1800 | 0.0001 | 3.03 | 0.512 |
| 1800 | 0.0003 | 5.15 | 0.459 |
| 1800 | 0.001 | 8.44 | 0.406 |
| 1800 | 0.003 | 13.62 | 0.352 |
| 1800 | 0.01 | 19.69 | 0.299 |
| 1800 | 0.03 | 25.79 | 0.249 |
| 1750 | 0.0001 | 4.43 | 0.497 |
| 1750 | 0.0003 | 7.48 | 0.440 |
| 1750 | 0.001 | 12.03 | 0.385 |
| 1750 | 0.003 | 18.65 | 0.329 |
| 1750 | 0.01 | 25.91 | 0.274 |
| 1750 | 0.03 | 33.83 | 0.220 |
| 1700 | 0.0001 | 6.85 | 0.453 |
| 1700 | 0.0003 | 10.95 | 0.400 |
| 1700 | 0.001 | 17.14 | 0.348 |
| 1700 | 0.003 | 24.97 | 0.295 |
| 1700 | 0.01 | 33.94 | 0.243 |
| 1700 | 0.03 | 42.56 | 0.192 |

TABLE II (ME3 alloy)

| Temperature ° F. | Strain Rate (/sec) | Stress (ksi) | "m" |
|---|---|---|---|
| 1800 | 0.0001 | 3.07 | 0.738 |
| 1800 | 0.0003 | 5.49 | 0.677 |
| 1800 | 0.001 | 9.59 | 0.612 |
| 1800 | 0.003 | 15.94 | 0.538 |
| 1800 | 0.01 | 23.62 | 0.458 |
| 1800 | 0.03 | 29.76 | 0.371 |
| 1750 | 0.0001 | 4.87 | 0.747 |
| 1750 | 0.0003 | 9.02 | 0.669 |
| 1750 | 0.001 | 15.14 | 0.582 |
| 1750 | 0.003 | 24.00 | 0.481 |
| 1750 | 0.01 | 31.98 | 0.367 |
| 1750 | 0.03 | 38.67 | 0.240 |
| 1700 | 0.0001 | 8.92 | 0.672 |
| 1700 | 0.0003 | 14.54 | 0.594 |
| 1700 | 0.001 | 23.02 | 0.508 |
| 1700 | 0.003 | 33.2 | 0.408 |
| 1700 | 0.01 | 42.89 | 0.297 |
| 1700 | 0.03 | 47.77 | 0.174 |

From this information, processing parameters were selected to achieve the required value of "m" of about 0.3 or greater, where "m" is an index of the extent of superplastic deformation of the material. The forging temperature is preferably from about 1700° F. to about 1850° F., and more preferably from about 1750° F. to about 1800° F. to reduce the risks of excessive oxidation of the workpiece at higher temperatures. The forging nominal strain rate is not greater than about 0.01 per second. The "nominal" strain rate is that determined from the gross rate of movement of the upper platen 48, normalized to the height of the workpiece 56 measured parallel to the direction of movement of the upper platen 48. Locally within the forging dies 52 and 54, the actual strain rate may be higher or lower.

The forging blank and the forging dies are heated to the isothermal forging temperature of from about 1700° F. to about 1850° F., step 26.

The forging blank is forged using the forging dies at the isothermal forging temperature of from about 1700° F. to about 1850° F. and at the forging nominal strain rate, step 28, using a forging apparatus such as the forging press 40 of FIG. 2.

The heating step 26 and the forging step 28 are preferably performed in air. The forging in air greatly reduces the cost of the forging operation as compared with forging in vacuum or an inert atmosphere, as required in prior processes for forging the nickel-base superalloys. The determination to forge in air is not an arbitrary one, and air forging may be performed only where the die material does not excessively oxidize in air at the forging temperature and also retains sufficient strength at the forging temperature. The conventional die material, TZM molybdenum, cannot be used at these temperatures in air because of its excessive oxidation.

After the forging operation of step 28 is complete, the forging 58 is removed from the forging press 40. The forging 58 may be used in the as-forged state, or it may be post processed, step 30. In the preferred case, the forgings of Rene™ 88DT or ME3 nickel-base superalloys are annealed at an annealing temperature above the gamma-prime solvus temperature. The supersolvus annealing is preferably at a temperature of from about 2080° F. to about 2100° F. for the Rene™ 88DT alloy and from about 2120° F. to about 2160° F. for the ME3 alloy, for a time of from about 1 to about 2 hours. Other types of post-processing 30 may include, for example, cleaning, other types of heat treating, additional metalworking, machining, and the like.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for providing a forging press and using the forging press to forge a nickle-base superalloy, comprising the steps of providing a forging blank of a forging nickel-base superalloy;

providing the forging press having forging dies made of a die nickel-base superalloy, wherein the die nickel-base superalloy has a creep strength of not less than a flow stress of the forging nickel-base superalloy at a forging temperature of from about 1700° F. to about 1850° F. and a forging nominal strain rate;

heating the forging blank and the forging dies in air to the forging temperature of from about 1700° F. to about 1850° F.; and forging the forging blank using the forging dies at the forging temperature of from about 1700° F. to about 1850° F. , in air and at the forging nominal strain rate.

2. The method of claim 1, wherein the step of providing the forging blank includes the step of providing the forging blank made of Rene™ 88DT, having a nominal composition, in weight percent, of 13 percent cobalt, 16 percent chromium, 4 percent molybdenum, 3.7 percent titanium, 2.1 percent aluminum, 4 percent tungsten, 0.75 percent niobium, 0.015 percent boron, 0.03 percent zirconium, and 0.03 percent carbon, up to about 0.5 percent iron, balance nickel and minor impurity elements.

3. The method of claim 1, wherein the step of providing the forging blank includes the step of providing the forging blank made of ME3, having a nominal composition, in weight percent, of about 20.6 percent cobalt, about 13.0 percent chromium, about 3.4 percent aluminum, about 3.70 percent titanium, about 2.4 percent tantalum, about 0.90 percent niobium, about 2.10 percent tungsten, about 3.80 percent molybdenum, about 0.05 percent carbon, about 0.025 percent boron, about 0.05 percent zirconium, up to about 0.5 percent iron, balance nickel and minor impurity elements.

4. The method of claim 1, wherein the step of providing the forging blank includes the step of providing the forging blank as consolidated powder.

5. The method of claim 1, wherein the step of providing the forging press includes the step of providing the forging dies having a nominal composition, in weight percent, of from about 5 to about 7 percent aluminum, from about 8 to about 15 percent molybdenum, from about 5 to about 15 percent tungsten, up to about 140 parts per million magnesium, balance nickel and impurities.

6. The method of claim 1, wherein the method includes an additional step of selecting the forging temperature to be from about 1750° F. to about 1800° F.

7. The method of claim 1, wherein the method includes an additional step of selecting the forging nominal strain rate to be not greater than about 0.01 per second.

8. A method for providing a forging press and using the forging press to forge a nickle-base superalloy, comprising the steps of providing a forging blank of a forging nickel-base superalloy selected from the group consisting of Rene™ 88DT, having a nominal composition, in weight percent, of 13 percent cobalt, 16 percent chromium, 4 percent molybdenum, 3.7 percent titanium, 2.1 percent aluminum, 4 percent tungsten, 0.75 percent niobium, 0.015 percent boron, 0.03 percent zirconium, and 0.03 percent carbon, up to about 0.5 percent iron, balance nickel and minor impurity elements, and ME3, having a nominal composition, in weight percent, of about 20.6 percent cobalt, about 13.0 percent chromium, about 3.4 percent aluminum, about 3.70 percent titanium, about 2.4 percent tantalum, about 0.90 percent niobium, about 2.10 percent tungsten, about 3.80 percent molybdenum, about 0.05 percent carbon, about 0.025 percent boron, about 0.05 percent zirconium, up to about 0.5 percent iron, balance nickel and minor impurity elements;

providing the forging press having forging dies made of a die nickel-base superalloy, wherein the die nickle-base superalloy has a creep strength of not less than a flow stress of the forging nickel-base superalloy at a forging temperature of from about 1700° F. to about 1850° F. and a forging nominal strain rate;

heating the forging blank and the forging dies to the forging temperature of from about 1700° F. to about 1850° F., in air; and forging the forging blank using the forging dies at the forging temperature of from about 1700° F. to about 1850° F. in air.

9. The method of claim 8, wherein the step of providing the forging blank includes the step of providing the forging blank as consolidated powder.

10. The method of claim 8, wherein the step of providing the forging press includes the step of providing the forging dies having nominal composition, in weight percent, of from about 5 to about 7 percent aluminum, from about 8 to about 15 percent molybdenum, from about 5 to about 15 percent tungsten, up to about 140 parts per million magnesium, balance nickel and impurities.

11. The method of claim 8, wherein the method includes an additional step of selecting the forging temperature to be from about 1750° F. to about 1800° F.

12. The method of claim 8, wherein the method includes an additional step of selecting a forging nominal strain rate to be not greater than about 0.01 per second, and wherein the step of forging includes the step of forging the forging blank at the nominal strain rate.

13. A method for providing a forging press and using the forging press to forge a nickle-base superalloy, comprising the steps of providing a consolidated powder forging blank of a forging nickel-base superalloy selected from the group consisting of Rene™ 88DT, having a nominal composition, in weight percent, of 13 percent cobalt, 16 percent chromium, 4 percent molybdenum, 3.7 percent titanium, 2.1 percent aluminum, 4 percent tungsten, 0.75 percent niobium, 0.015 percent boron, 0.03 percent zirconium, and 0.03 percent carbon, up to about 0.5 percent iron, balance nickel and minor impurity elements, and ME3, having a nominal composition, in weight percent, of about 20.6 percent cobalt, about 13.0 percent chromium, about 3.4 percent aluminum, about 3.70 percent titanium, about 2.4 percent tantalum, about 0.90 percent niobium, about 2.10 percent tungsten, about 3.80 percent molybdenum, about 0.05 percent carbon, about 0.025 percent boron, about 0.05 percent zirconium, up to about 0.5 percent iron, balance nickel and minor impurity elements;

providing the forging press having forging dies made of a die nickel-base superalloy having a nominal composition, in weight percent, of from about 5 to about 7 percent aluminum, from about 8 to about 15 percent molybdenum, from about 5 to about 15 percent tungsten, up to about 140 parts per million magnesium, balance nickel and impurities;

heating the forging blank and the forging dies to the forging temperature of from about 1700° F. to about 1850° F., in air; and forging the forging blank using the forging dies at the forging temperature of from about 1700° F. to about 1850° F. at a nominal strain rate no greater than about 0.01 per second, in air.

14. The method of claim 1, including an additional step, after the step of forging, of annealing the forged forging blank at an annealing temperature above a gamma prime solvus temperature of the forging nickel-base superalloy.

15. The method of claim 8, including an additional step, after the step of forging, of annealing the forged forging blank at an annealing temperature above a gamma prime solvus temperature of the forging nickel-base superalloy.

16. The method of claim 13, including an additional step, after the step of forging, of annealing the forged forging blank at an annealing temperature above a gamma prime solvus temperature of the forging nickel-base superalloy.

17. A method for providing a forging press and using the forging press to forge a nickel-base superalloy, comprising the steps of providing a forging blank of a forging nickel-base superalloy;

providing the forging press having forging dies made of a die nickel-base superelloy, wherein the die nickel-base superalloy has a creep strength of not less than a flow stress of the forging nickel-base superalloy at a forging temperature of from about 1700° F. to about 1850° F. and a forging nominal strain rate of not greater than about 0.01 per second;

heating the forging blank and the forging dies to the forging temperature of from about 1700° F. to about 1850° F.; and forging the forging blank using the forging dies at the forging temperature of from about 1700° F. to about 1850° F. and at the forging nominal strain rate.

18. The method of claim 17, wherein the method includes an additional step of selecting the forging temperature to be from about 1750° F. to about 1800° F.

19. The method of claim 13, wherein the method includes an additional step of selecting the forging temperature to be from about 1750° F. to about 1800° F.

* * * * *

UNITED STATES PATENT AND TRADEMARK OFFICE

CERTIFICATE OF CORRECTION

PATENT NO. : 6,908,519 B2
DATED : June 21, 2005
INVENTOR(S) : Raymond et al.

It is certified that error appears in the above-identified patent and that said Letters Patent is hereby corrected as shown below:

Column 6,
Line 52, "air and" should be -- air, and --.

Signed and Sealed this

Thirty-first Day of January, 2006

JON W. DUDAS
*Director of the United States Patent and Trademark Office*